US008162703B2

(12) United States Patent
Bamba

(10) Patent No.: US 8,162,703 B2
(45) Date of Patent: Apr. 24, 2012

(54) MARINE VESSEL POWER SUPPLY SYSTEM, MARINE VESSEL PROPULSION SYSTEM, AND MARINE VESSEL

(75) Inventor: Takaaki Bamba, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 375 days.

(21) Appl. No.: 12/538,892

(22) Filed: Aug. 11, 2009

(65) Prior Publication Data

US 2010/0048068 A1 Feb. 25, 2010

(30) Foreign Application Priority Data

Aug. 22, 2008 (JP) ..... 2008-214382

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 5,788,004 | A * | 8/1998 | Friedmann et al. | 180/65.28 |
| 2006/0089060 | A1 | 4/2006 | Kawase et al. | |
| 2007/0293102 | A1 | 12/2007 | Okuyama et al. | |
| 2008/0020656 | A1 | 1/2008 | Yamada et al. | |
| 2008/0026649 | A1 | 1/2008 | Ito et al. | |

FOREIGN PATENT DOCUMENTS

| | | | |
|---|---|---|---|
| JP | 09-009517 | A | 1/1997 |
| JP | 2007-253638 | A | 10/2007 |
| JP | 2008-025505 | A | 2/2008 |
| JP | 2008-030608 | A | 2/2008 |

* cited by examiner

*Primary Examiner* — Stephen Avila
(74) *Attorney, Agent, or Firm* — Keating & Bennett, LLP

(57) ABSTRACT

A marine vessel power supply system supplies power to a plurality of propulsion devices each provided with an engine. The system includes a plurality of switching units arranged to turn on and off power supplies to the propulsion devices individually, an operation judgment unit arranged to judge whether the engine of each propulsion device is in an operating state or in a stopped state, and a power supply control unit arranged to turn off a switching unit of the plurality of switching units, when a switching unit is in the ON state and if the engine of the propulsion device corresponding to the switching unit is in a stopped state for not less than a predetermined time.

7 Claims, 10 Drawing Sheets

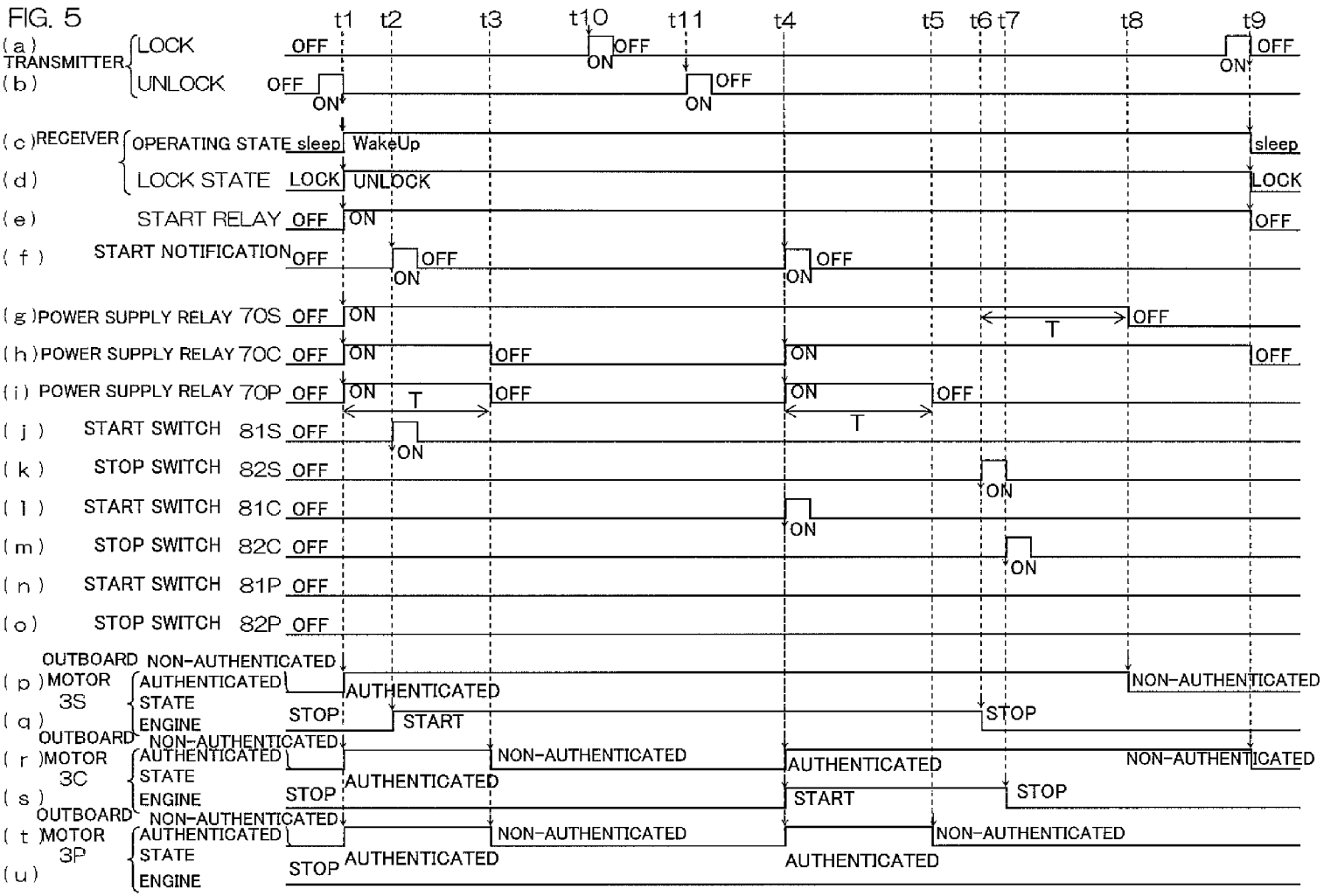
FIG. 5
(a) TRANSMITTER LOCK
(b) UNLOCK
(c) RECEIVER OPERATING STATE
(d) LOCK STATE
(e) START RELAY
(f) START NOTIFICATION
(g) POWER SUPPLY RELAY 70S
(h) POWER SUPPLY RELAY 70C
(i) POWER SUPPLY RELAY 70P
(j) START SWITCH 81S
(k) STOP SWITCH 82S
(l) START SWITCH 81C
(m) STOP SWITCH 82C
(n) START SWITCH 81P
(o) STOP SWITCH 82P
(p) OUTBOARD MOTOR 3S
(q) OUTBOARD MOTOR 3C
(r) OUTBOARD MOTOR 3P
(s) NON-AUTHENTICATED
(t) AUTHENTICATED
(u) STATE
ENGINE
t1
t2
t3
t10
t11
t4
t5
t6
t7
t8
t9
OFF
ON
sleep
WakeUp
LOCK
UNLOCK
T
STOP
START
NON-AUTHENTICATED
AUTHENTICATED

MARINE VESSEL POWER SUPPLY SYSTEM, MARINE VESSEL PROPULSION SYSTEM, AND MARINE VESSEL

BACKGROUND OF THE INVENTION

1. Field of the Invention

The present invention relates to a marine vessel power supply system that supplies power to a plurality of propulsion devices provided with engines, and to a marine vessel propulsion system and a marine vessel that use the marine vessel power supply system.

2. Description of the Related Art

An exemplary propulsion device for a marine vessel is an outboard motor. The outboard motor is, for example, attached to a stern of a hull. The outboard motor is a device with which a propulsive force is obtained by rotation of a propeller drove by a power of an engine. A plurality of outboard motors may be attached to the hull in accordance with the required propulsive force. The outboard motor includes an outboard motor ECU (electronic control unit) for output control of the engine, etc.

A steering apparatus, a remote control apparatus for adjusting the output of the outboard motor, and a gauge (meter) for displaying a state of the outboard motor are disposed at a marine vessel maneuvering compartment of the marine vessel. The steering apparatus includes, for example, a steering wheel or handle. Operation of the steering wheel or handle is transmitted by a cable to the outboard motor to enable the direction of the outboard motor to be changed. The remote control apparatus has a lever for shift position selection and engine output adjustment of the outboard motor. Operation of the lever is transmitted to the outboard motor via a cable. Shift positions include a forward drive position, a neutral position, and a reverse drive position. When the forward drive position is selected, a propeller rotation direction is set to the rotation direction that provides the propulsive force in the forward drive direction to the marine vessel. When the reverse drive position is selected, the propeller rotation direction is set to the rotation direction that provides the propulsive force in the reverse drive direction to the marine vessel. At the neutral position, the output of the engine is not transmitted to the propeller. The gauge includes a liquid crystal display unit, etc., and displays an operation state of the outboard motor, the engine output (rotation speed), etc. When a plurality of outboard motors are provided, a plurality of gauges are provided accordingly and displays are performed in correspondence to the respective outboard motors.

A local area network (inboard LAN) is constructed inside the marine vessel. The outboard motor ECU and the gauge are connected to the inboard LAN and data communication between these components is thereby enabled.

One battery preferably is provided for each outboard motor. Power is supplied to a starter for starting the engine and to the outboard motor ECU from this battery. The marine vessel maneuvering compartment includes a power supply switch for switching between supplying and turning off the power from the battery to the outboard motor. When a plurality of outboard motors are provided, a plurality of power supply switches are provided accordingly (see US 2006/0089060). The power supply switch has, for example, a form of a key switch and serves as a start switch for starting the engine as well. More specifically, when the key switch is operated from an off position to an on position, power is supplied from the battery to the outboard motor. When the key switch is operated further from the on position to the start position, the starter is actuated and a cranking operation is performed.

SUMMARY OF THE INVENTION

The inventor of preferred embodiments of the invention described and claimed in the present application conducted an extensive study and research regarding a marine vessel power supply system, and in doing so, discovered and first recognized new unique challenges and problems as described in greater detail below.

More specifically, to start the propulsion device (for example, the outboard motor), the operation of turning on the power supply has to be performed by operating the power supply switch, and further, the starting operation for starting the propulsion device has to be performed. When a plurality of propulsion devices are provided, this operation has to be repeated for the number of times corresponding to the number of propulsion devices. The operation for starting, in particular, the operation for turning on the power supply is thus troublesome.

Providing of a power supply switch in common for the plurality of propulsion devices may thus be considered. That is, the power supplies of the plurality of propulsion devices are turned on all at once by a power-on operation of a single power supply switch. The power-on operation is thereby simplified. The propulsive forces of the plurality of propulsion devices may not be required necessarily, and thus in regard to the starting of the engine of each individual propulsion device, an arrangement that enables the starting to be performed individually is highly convenient.

However, when the power supplies of the plurality of propulsion devices are turned on all at once, consumption of power by the propulsion devices, with which the engines are not started for a long time, becomes a problem. Specifically, if the power supplies are kept on with the engines not being started, the power of the corresponding batteries is consumed and eventually the batteries may run out of power. Needless to say, there is also a problem in terms of energy savings.

In order to overcome the previously unrecognized and unsolved problems as described above, a preferred embodiment of the present invention provides a marine vessel power supply system arranged to supply power to a plurality of propulsion devices each provided with an engine. The system includes a plurality of switching units arranged to turn on and off power supplies to the propulsion devices individually, an operation judgment unit arranged to judge whether the engine of each propulsion device is in an operating state or in a stopped state, and a power supply control unit. The power supply control unit is arranged to turn off a switching unit of the plurality of the switching units, when the switching unit is in the on state, if the engine of the propulsion device corresponding to the switching unit is in a stopped state for not less than a predetermined time.

With this configuration, a power supply system for a marine vessel propulsion system having a plurality of propulsion devices is provided. With this power supply system, the operation state of an engine is monitored when the corresponding switching unit is in the on state and power is being supplied to the corresponding propulsion device. If the engine is in the stopped state for not less than the predetermined time, the switching unit is controlled to become off and the power supply to the corresponding propulsion device is thereby turned off. Thus, for example, even in a configuration where a plurality of switching units are controlled to be in the on state all at once by a power-on operation by a user to improve user-friendliness of the turning on of power, wasteful power consumption can be prevented. Thus, in a case where a battery is provided in correspondence to each individual propulsion system, complete discharge (running out of power) of the battery can be suppressed or prevented.

In a preferred embodiment of the present invention, when a switching unit is in the on state, the power supply control unit turns off the switching unit if the engine of the propulsion device corresponding to the switching unit is in the stopped state for not less than the predetermined time and the power supply to at least one of the propulsion devices not corresponding to the switching unit is continued.

With this configuration, the continuation of power supply to another propulsion device becomes a condition for turning off the switching unit corresponding to a certain propulsion device. Power supply to other systems provided in the marine vessel can thereby be secured.

For example, in a case where an inboard local area network (hereinafter referred to as the "inboard LAN") is constructed, a system power supply for the inboard LAN can be secured. More specifically, a system power supply circuit may be provided to secure the system power supply for the inboard LAN if the power supply of at least one of the propulsion devices is turned on. In this case, the system power supply of the inboard LAN is not lost as long as the power supply to the other propulsion device is continued, and the switching unit can thus be put in the OFF state without any problem.

In a preferred embodiment of the present invention, a priority order is set in advance in regard to the turning off of the power supplies of the plurality of propulsion devices, and when the switching units are in the on state, the power supply control unit turns off the switching units in accordance with the priority order if the engines of all the propulsion devices in the power supplied state are all in the stopped state for not less than the predetermined time.

With this configuration, when the power-off condition (stoppage of the engine for not less than the predetermined time) is met for the plurality of propulsion devices, the switching units are turned off according to the priority order set in advance. That is, a condition for the turning-off of a certain switching unit is that the power-off priority order is higher than that of the other propulsion devices. In other words, the condition is that the priority order of maintenance of power supply is low. Thus, for a propulsion device of low power-off priority order (high priority order of maintenance of power supply), the switching unit is held in the on state. The single switching unit that remains last is held in the on state because no other propulsion device of lower priority order (in the power-on state) exists. Power supply to the other systems (for example, the above mentioned inboard LAN) provided in the marine vessel can thereby be secured. When an operation for turning off all power supplies of the marine vessel propulsion system is performed by a user, all the switching units are put in the off state and the power to the above-mentioned systems is also turned off.

For example, a gauge (meter) that indicates an operation state of a propulsion device may be connected to the inboard LAN. The power supply for the gauge can be supplied from the system power supply of the inboard LAN. In this case, if the power supply to the gauge is turned off, a distinction cannot be made with respect to the case where all power supplies of the marine vessel propulsion system are turned off. There is thus a possibility for a user of the marine vessel to leave the marine vessel without turning off all power supplies of the marine vessel propulsion system. This situation is unfavorable from a standpoint of deterring theft of the marine vessel. It is thus preferable to maintain at least the system power supply of the inboard LAN until all power supplies of the marine vessel propulsion system are turned off.

The marine vessel power supply system according to a preferred embodiment of the present invention further includes a start command unit arranged to generate a start command for commanding starting of the engine. Preferably in this case, when a switching unit is in the off state, the power supply control unit controls the switching unit to be in the on state in response to the generation of the start command by the start command unit.

With this configuration, when the start command is generated from the start command unit, the switching unit is controlled to be in the on state. Because the power supply of the propulsion device is thereby turned on, the engine of the propulsion device that received the start command is started. Thus, even if the switching unit is put in the OFF state automatically and the propulsion device is in the power-off state, the propulsion device can be started without requiring the operation for turning on the power supply to be performed again. The starting of the engine can thus be improved in user-friendliness.

Preferably, the start command unit may be arranged to generate the start command for starting the engine of each of the plurality of propulsion devices individually. That is, a plurality of starting operational units that respectively correspond to the plurality of propulsion devices may be provided. In this case, the power supply control unit may control all of the switching units to be in the on state in response to the start command. Alternatively, the power supply control unit may select and control the switching unit corresponding to the start command to be in the on state.

The marine vessel power supply system according to a preferred embodiment of the present invention further includes an operational unit arranged to be operated by a user to turn on the power supply. Preferably in this case, in response to a predetermined power-on operation on the operational unit, the power supply control unit may put the plurality of switching units successively in the on state in an order determined in advance.

With this configuration, when the predetermined power-on operation is performed on the operational unit for turning on the power, the plurality of switching units are put in the on state successively in the predetermined order. The power supplies of the plurality of propulsion devices are thus put in the on state successively in the predetermined order. The control accompanying the turning on of the power supplies in the respective propulsion devices can thereby be performed successively.

For example, when a plurality of propulsion devices are connected to the inboard LAN, identification numbers (hereinafter referred to as "ID Nos.") must be set for communication via the inboard LAN. An initial setting for determining the ID Nos. of the respective propulsion devices is thus performed after constructing the inboard LAN. In this process, by the power supplies of the plurality of propulsion devices being turned on not simultaneously but successively, the ID Nos. can be provided successively to the propulsion devices without overlapping.

For example, each propulsion device may include an ID No. setting unit. The ID No. setting unit is arranged to generate an ID No. that is changed from a predetermined initial value in an order determined in advance. The ID No. is changed until the self-generated ID No. is no longer in conflict with the ID Nos. of other equipments connected to the inboard LAN. Such an ID No. setting process may be performed when the predetermined power-on operation is performed on the operational unit. Because the power supplies of the plurality of propulsion devices are turned on successively, the ID No. setting process is performed successively in each propulsion device. Each propulsion device can thus readily set an ID No. that is not in conflict with those of the other propulsion devices.

A preferred embodiment of the present invention provides a marine vessel propulsion system that includes a plurality of propulsion devices each provided with an engine, and the above-described marine vessel power supply system arranged to supply power to the plurality of propulsion devices. With this configuration, a marine vessel propulsion system that is excellent in energy saving properties can be provided, and the power-on operation can be simplified and improved in user-friendliness while suppressing and minimizing energy consumption.

Further, a preferred embodiment of the present invention provides a marine vessel that includes a hull, a plurality of propulsion devices attached to the hull and each provided with an engine, and the above-described marine vessel power supply system arranged to supply power to the plurality of propulsion devices. With this configuration, a marine vessel provided with a marine vessel propulsion system that is excellent in energy saving properties can be provided, and the power-on operation can be simplified and improved in user-friendliness while suppressing and minimizing energy consumption.

Other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a time chart for explaining operations related to power supply control of the outboard motors.

DETAILED DESCRIPTION OF THE PREFERRED EMBODIMENTS

Figure 1:
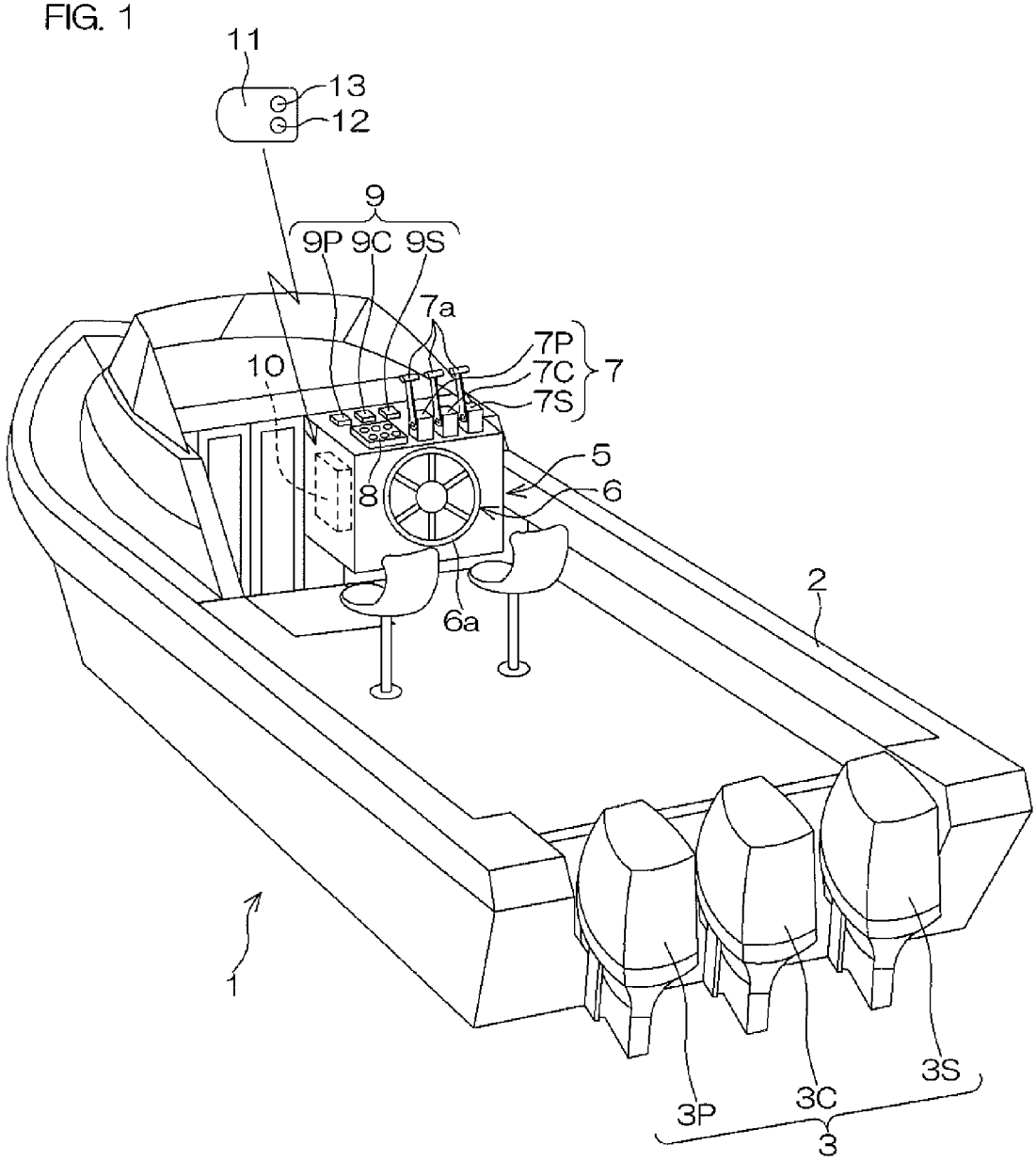
FIG. 1 is a perspective view for explaining a configuration of a marine vessel according to a preferred embodiment of the present invention.

FIG. 1 is a perspective view for explaining a configuration of a marine vessel according to a preferred embodiment of the present invention. The marine vessel 1 includes a hull 2 and outboard motors 3 as propulsion devices. A plurality of the outboard motors 3 (for example, three motors in the present preferred embodiment) are provided. These outboard motors 3 are attached in parallel to a stern of the hull 2. When each of the three outboard motors is to be distinguished, that disposed at a starboard side shall be referred to as the "starboard side outboard motor 3S," that disposed at a center shall be referred to as the "central outboard motor 3C" and that disposed at a portside shall be referred to as the "portside outboard motor 3P." Each of the outboard motors 3 includes an engine and generates a propulsive force by means of a screw that is rotated by a driving force of the engine.

A marine vessel maneuvering compartment 5 is disposed at a front portion (stem side) of the hull 2. The marine vessel maneuvering compartment 5 includes a steering apparatus 6, remote controllers 7, an operational panel 8, and gauges 9.

The steering apparatus 6 includes a steering wheel 6*a* that is rotatingly operated by an operator. The operation of the steering wheel 6*a* is mechanically transmitted by a cable (not shown) to a steering mechanism (not shown) disposed at the stern. The steering mechanism changes the directions of the three outboard motors 3 in a coupled manner. The directions of the propulsive forces are thereby changed and a heading direction of the marine vessel 1 can be changed accordingly.

Three remote controllers 7 are provided in correspondence to the three outboard motors 3. When these are to be distinguished, that corresponding to the starboard side outboard motor 3S shall be referred to as the "starboard side remote controller 7S," that corresponding to the central outboard motor 3C shall be referred to as the "central remote controller 7C," and that corresponding to the portside outboard motor 3P shall be referred to as the "portside remote controller 7P." Each remote controller 7 has a lever 7*a* capable of inclination in forward and reverse directions, and operation of the lever 7*a* is transmitted to the corresponding outboard motor 3 via a cable (not shown). By inclining the lever 7*a* forward from a predetermined neutral position, a shift position of the outboard motor 3 is set at a forward drive position and a propulsive force in the forward drive direction is generated from the outboard motor 3. By inclining the lever 7*a* in the reverse direction from the neutral position, the shift position of the outboard motor 3 is set at a reverse drive position and a propulsive force in the reverse drive direction is generated from the outboard motor 3. When the lever 7*a* is at the neutral position, the shift position of the outboard motor 3 is set at the neutral position and the outboard motor 3 does not generate a propulsive force. Further, the output of the outboard motor 3, that is, the engine speed provided in the outboard motor 3 can be varied according to the inclination amount of the lever 7*a*.

The operational panel 8 includes three start switches arranged to be operated by a user to start the engines of the three outboard motors 3 individually and three stop switches arranged to be operated by a user to stop the engines of the three outboard motors 3 individually.

Three gauges 9 are provided in correspondence to the three outboard motors 3. When these are to be distinguished, that corresponding to the starboard side outboard motor 3S shall be referred to as the "starboard side gauge 9S," that corresponding to the central outboard motor 3C shall be referred to as the "central gauge 9C," and that corresponding to the portside outboard motor 3P shall be referred to as the "portside gauge 9P." These gauges 9 display statuses of the corresponding outboard motors 3. More specifically, the gauges 9 display the power on/off state, the engine speed, and other necessary information on the corresponding outboard motor 3.

The marine vessel maneuvering compartment 5 further includes an immobilizer 10 (receiver). The immobilizer 10 receives signals from a key unit 11 to be carried by a user of the marine vessel 1 and is a device that allows ordinary use of the marine vessel 1 only to a legitimate user. The key unit 11 includes a lock button 12 and an unlock button 13. The lock button 12 is a button that is operated to set the immobilizer 10 in a locked state. By operation of the lock button 12, a lock signal is sent from the key unit 11. When the immobilizer 10 is set in the locked state, the marine vessel 1 is put in a state in which ordinary use is prohibited. The unlock button 13 is a button that is operated to release the locked state and set the immobilizer 10 in an unlocked state to start ordinary use of the marine vessel 1. By operation of the unlock button 13, an unlock signal is sent from the key unit 11. The key unit 11 sends a user authentication code along with the lock signal and the unlock signal.

The immobilizer 10 receives the user authentication code from the key unit 11 and executes a user authentication process. That is, the immobilizer 10 checks matching or non-matching with collation source data that are registered in advance. If the user authentication process succeeds, the immobilizer 10 accepts the lock signal and the unlock signal from the key unit 11. If the user authentication process fails, the immobilizer 10 becomes unresponsive to the lock signal and the unlock signal from the key unit 11.

Figure 2:
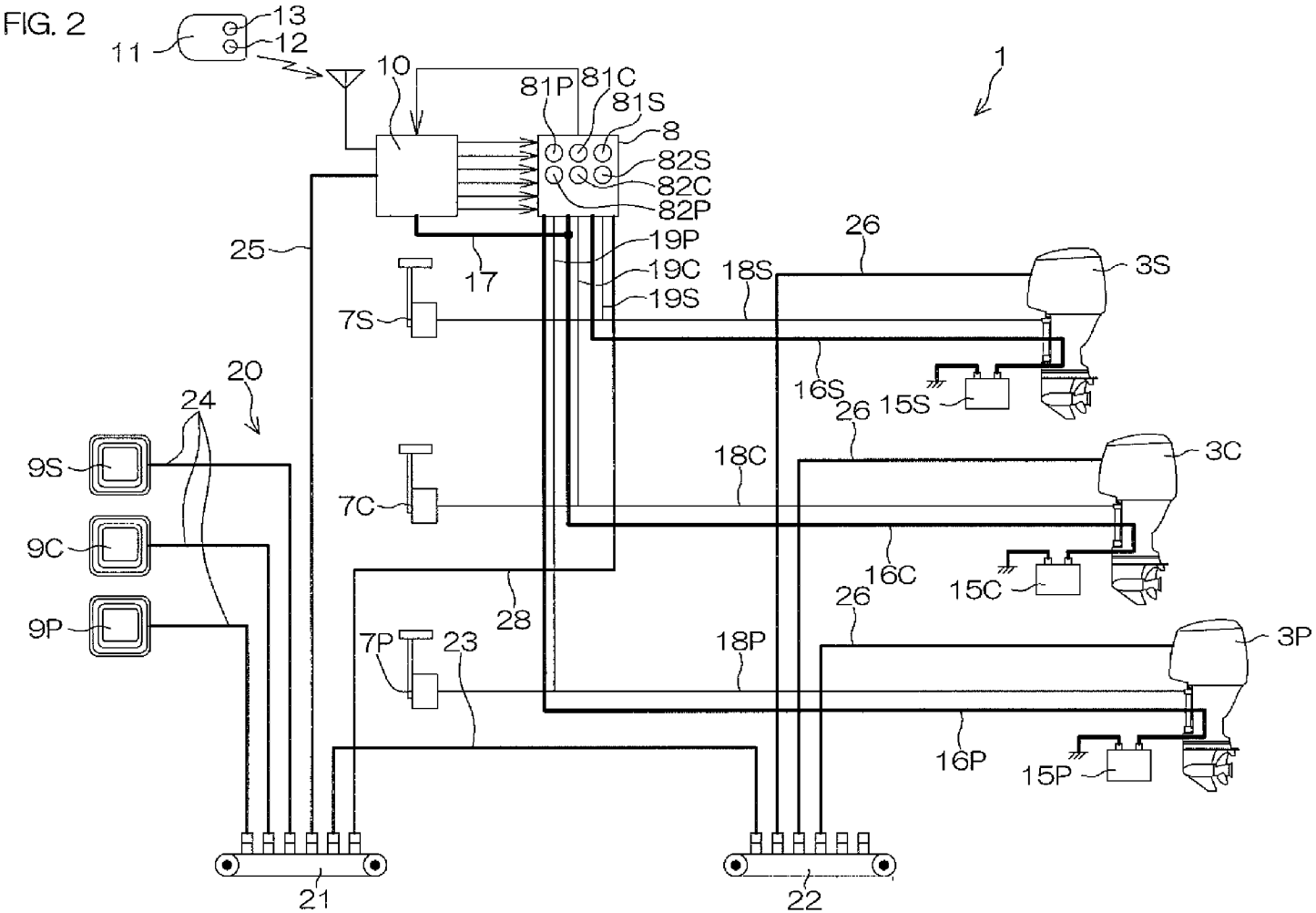
FIG. 2 is a diagram for explaining an electrical configuration of the marine vessel.

FIG. 2 is a diagram for explaining an electrical configuration of the marine vessel 1. The operational panel 8 includes three individually operable start switches 81S, 81C, and 81P, and three individually operable stop switches 82S, 82C, and 82P. Thus, three pairs of start switches and stop switches are provided in correspondence to the three outboard motors 3. The pair of the start switch 81S and the stop switch 82S corresponds to the starboard side outboard motor 3S. The pair of the start switch 81C and the stop switch 82C corresponds to the central outboard motor 3C. Likewise, the pair of the start switch 81P and the stop switch 82P corresponds to the portside outboard motor 3P. By individually operating the start switches 81S, 81C, and 81P, the engines of the three outboard motors 3 can be started individually. Also, by individually operating the stop switches 82S, 82C, and 82P, the engines of the three outboard motors 3 can be stopped individually.

Three batteries 15 are respectively disposed in correspondence to the three outboard motors 3. That is, a battery 15S corresponding to the starboard side outboard motor 3S, a battery 15C corresponding to the central outboard motor 3C, and a battery 15P corresponding to the portside outboard motor 3P are provided. These batteries 15S, 15C, and 15P are respectively connected via power supply cables 16S, 16C, and 16P to the outboard motors 3S, 3C, and 3P. The batteries 15 are not necessarily disposed close to the outboard motors 3 and are disposed at suitable locations of the hull 2 in accordance with a design of a boat builder.

Further, the power supply cables 16S, 16C, and 16P are drawn from the outboard motors 3S, 3C, and 3P to the operational panel 8. Power supply relays to be described later and disposed inside the operational panel 8 are individually interposed in the respective power supply cables 16S, 16C, and 16P. Further, a power supply line 17 is branched from a power supply cable 16 (for example, the power supply cable 16C) from a battery 15 (for example, the battery 15C) corresponding to a single, specific outboard motor 3 (for example, the central outboard motor 3C). The power supply line 17 is connected to the immobilizer 10. The immobilizer 10 thus always receives the supply of power from the battery 15.

Control signal lines 18S, 18C, and 18P are respectively connected to the outboard motors 3S, 3C, and 3P. The remote controllers 7S, 7C, and 7P are respectively connected to the control signal lines 18S, 18C, and 18P. The remote controllers 7S, 7C, and 7P generate remote controller authentication codes and send the codes to the control signal lines 18S, 18C, and 18P. An outboard motor 3 is put in an operation disabled state unless a remote controller authentication code that has been registered in advance is received. Further, starting signal lines 19S, 19C, and 19P of the operation panel 8 are respectively connected to the control signal lines 18S, 18C, and 18P. When starting commands are delivered to the starting signal lines 19S, 19C, and 19P, the starters of the corresponding outboard motors 3 are actuated in response and the engines are started.

An inboard LAN (local area network) 20 is constructed inside the hull 2. Specifically, the outboard motors 3, the immobilizer 10, and the gauges 9 are connected to the inboard LAN 20 and enabled to send and receive data and control signals. Further, a stem side hub 21 is disposed close to the marine vessel maneuvering compartment 5, a stern side hub 22 is disposed at the stern side, and these are connected to each other via a LAN cable 23. To the stem side hub 21, the gauges 9 are connected via LAN cables 24 and the immobilizer 10 is connected via a LAN cable 25. The outboard motors 3 are connected via LAN cables 26 to the stern side hub 22. A system power for the inboard LAN 20 is supplied to the stem side hub 21 via a system power supply line 28 from a system power supply circuit to be described later and disposed inside the operational panel 8.

The LAN cables 23 to 26 are configured by binding power supply lines and signal lines. The LAN cables 23 to 26 are thus capable of sending power from the system power supply line 28 via the power supply lines and transmitting communication signals among the respective equipment via the signal lines. In particular, the supply of power to the gauges 9 is achieved via the system power supply line 28, the stem side hub 21, and the LAN cables 24.

Figure 3:
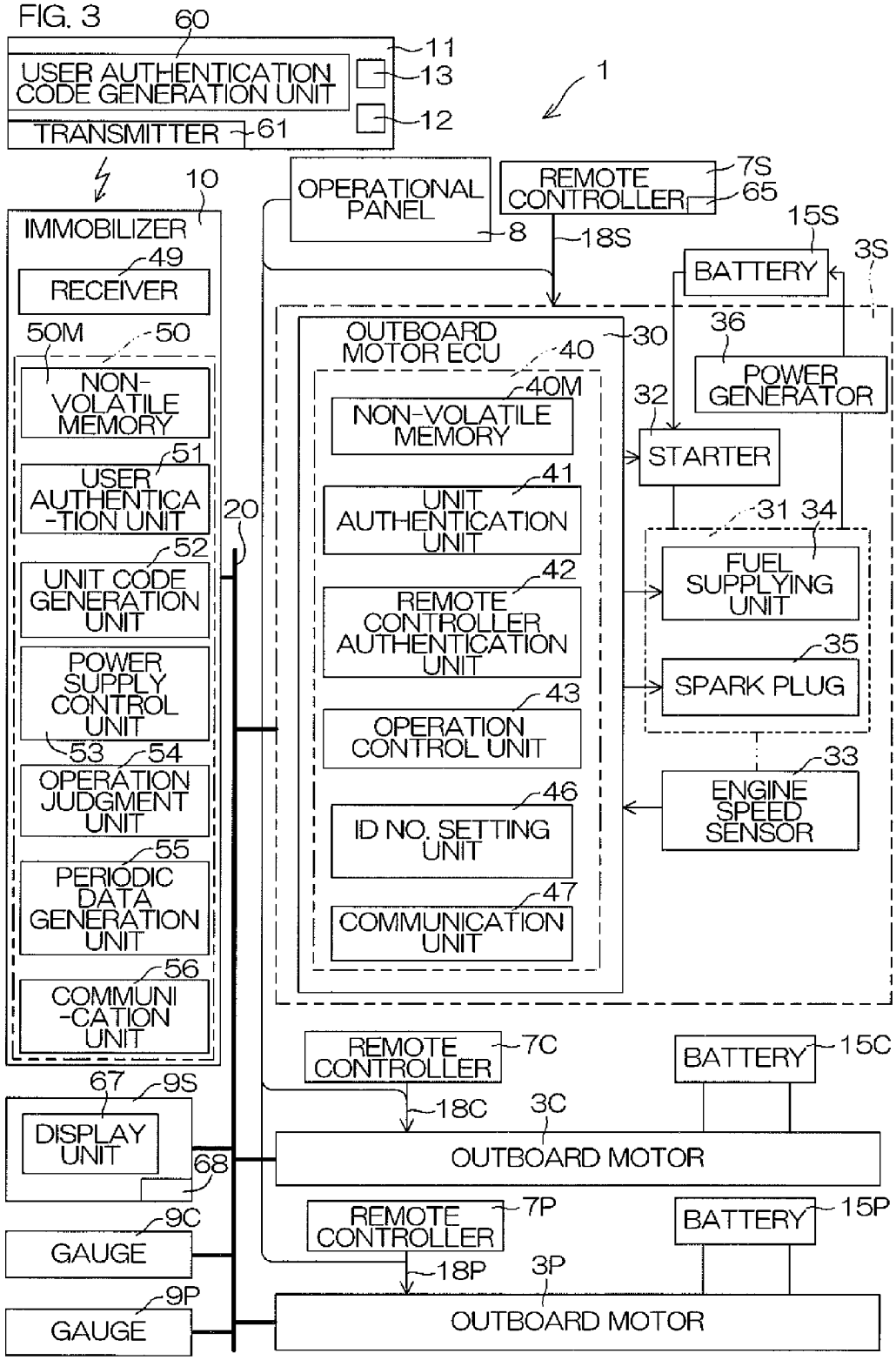
FIG. 3 is a block diagram for explaining the electrical configuration of the marine vessel in further detail.

FIG. 3 is a block diagram for explaining the electrical configuration of the marine vessel 1 in further detail. Each outboard motor 3 includes an outboard motor ECU (electronic control unit) 30, an engine 31, a starter 32, an engine speed sensor 33, and a power generator 36. The engine 31 includes a fuel supplying unit 34 and a spark plug 35. The fuel supplying unit 34 includes, for example, an injector that is arranged to inject fuel into an air intake path of the engine 31. The spark plug 35 discharges inside a combustion chamber of the engine 31 and ignites a mixed gas inside the combustion chamber. Operations of the fuel supplying unit 34 and the spark plug 35 are controlled by the outboard motor ECU 30. The starter 32 is a device that rotates upon receiving power from the battery 15 and is arranged to perform cranking of the engine 31 by the rotational force. The engine speed sensor 33 detects the rotational speed of the engine 31 or more specifically, the rotational speed of a crankshaft. The power generator 36 has a rotor that is rotated by the driving force of the engine 31 and generates power by rotation of the rotor. The corresponding battery 15 is charged by this power.

The outboard motor ECU 30 includes a computer 40 (microcomputer) and drive circuits (not shown) that drive the fuel supplying unit 34, the spark plug 35, etc., and is connected to the inboard LAN 20. The computer 40 includes a CPU, a ROM, a RAM and other necessary memories, and interfaces. In particular, the computer 40 includes a non-volatile memory 40M (for example, a rewritable memory such as an EEPROM) for storing authentication source data for the immobilizer 10, authentication source data for the remote controller 7, etc., as shall be described later.

By the CPU executing predetermined operation programs stored in the ROM, the computer 40 functions as a plurality of functional processing units. The functional processing units include a unit authentication unit 41, a remote controller authentication unit 42, an operation control unit 43, an ID No. setting unit 46, and a communication unit 47.

A function of the computer 40 as the unit authentication unit 41 is authentication of a unit authentication code sent by the immobilizer 10. More specifically, the computer 40 requests the immobilizer 10 to send the unit authentication code. In response, the immobilizer 10 sends the unit authentication code via the inboard LAN 20. The unit authentication code is received by the computer 40. The computer 40 collates the received unit authentication code with authentication source data (the legitimate unit authentication code) registered in advance in the non-volatile memory 40M and generates the collation result (success or failure).

A function of the computer 40 as the remote controller authentication unit 42 is authentication of a remote controller authentication code sent by each remote controller 7. More specifically, the computer 40 receives the remote controller authentication code from the corresponding remote controller 7 via the control signal line 18. Further, the computer 40 collates the received remote controller authentication code with authentication source data (the legitimate remote controller authentication code) registered in advance in the non-volatile memory 40M and generates the collation result (success or failure).

Functions of the computer 40 as the operation control unit 43 include allowing of operation (allowing of starting) and prohibition of operation (prohibition of starting) of the outboard motors 3. Specifically, the computer 40 receives data indicating whether the immobilizer 10 is in the locked state or in the unlocked state from the immobilizer via the inboard LAN 20. When the immobilizer 10 is in the unlocked state and the unit authentication result and the remote controller authentication result are both "successful," the computer 40 allows the operation of the outboard motors 3.

Functions of the computer 40 as the operation control unit 43 further include actuation of the starters 32 in response to the starting commands provided via the corresponding control signal line 18 from the operation panel 8. The corresponding engine 31 is thereby started. Functions of the computer 40 as the operation control unit 43 further include control of stopping of the corresponding engines 31 in response to a stop command provided from the operational panel 8 and via the corresponding control signal line 18. Specifically, the corresponding engine 31 is stopped by stoppage of fuel supply by the fuel supplying unit 34 and stoppage of the ignition operation by the spark plug 35.

A function of the computer 40 as the ID No. setting unit 46 is to determine an ID No., which is a unique identification number on the inboard LAN 20, and set it in the corresponding outboard motor 3. The setting of the ID No. is a part of an initial setting, and once the initial setting is performed, the ID No. of the corresponding outboard motor 3 is registered and saved in the non-volatile memory 40M. The initial setting is performed when the setting of the ID No. is incomplete when the power of the outboard motor ECU 30 is turned on.

In the present preferred embodiment, the ID No. setting process can be performed by performing a predetermined operation for the initial setting from the key unit 11. Specifically, this operation is a press-and-hold operation of the unlock button 13. The press-and-hold operation is a continuous operation that lasts for not less than a predetermined time. When the press-and-hold operation is detected by the immobilizer 10, the immobilizer 10 turns on the power supplies of the plurality of outboard motors 3 successively in an order determined in advance and with a fixed time interval in between by control of the power supply relays inside the operational panel 8.

In the power-on process, the computer 40 checks whether or not an ID No. is registered in the non-volatile memory 40M, and, if an ID No. is not registered, executes the ID No. setting process. The ID No. setting process includes a process of sending, to the inboard LAN 20, an ID No. that is successively incremented at a fixed time interval from an initial value set in advance. The computer 40 sends the ID No. to the inboard LAN 20 and monitors identification numbers sent by other equipments connected to the inboard LAN 20. If an identification number that conflicts with the ID No. sent by the computer itself is not sent to the inboard LAN 20, the present ID No. is determined and registered in the non-volatile memory 40M as the ID No. of the corresponding outboard motor 3.

When the power supplies are turned on for all of the plurality of outboard motors 3 simultaneously in a case where an ID No. has not been set for any of the outboard motors 3, the ID Nos. sent from the motors may conflict repeatedly on the inboard LAN 20 and the ID Nos. thus cannot be determined smoothly. Thus, in the present preferred embodiment, when the initial setting is performed (when the press-and-hold operation of the unlock button 13 is performed), the turning on of the power supplies to the plurality of outboard motors 3 is performed successively in the predetermined order and with a predetermined time interval in between. Conflicts of the ID Nos. on the inboard LAN 20 can thereby be avoided and the ID Nos. can thus be set smoothly.

A function of the computer 40 as the communication unit 47 is communication with other equipments connected to the inboard LAN 20. Locked or unlocked state data can be acquired from the immobilizer 10, display commands can be provided to the gauges 9, for example, by this communication.

The immobilizer 10 includes a receiver 49 and a computer 50 (microcomputer). The receiver 49 receives the signal from the key unit 11 and transfers the signal to the computer 50. The computer 50 includes a CPU, a ROM, a RAM and other necessary memories. In particular, the computer 50 includes a non-volatile memory 50M (for example, a rewritable memory such as an EEPROM). The collation source data (the legitimate user identification code) for collating the user identification code generated by the key unit 11 are registered in advance in the non-volatile memory 50M.

By execution of predetermined programs stored in the ROM, the computer 50 functions as a plurality of functional processing units. The functional processing units include a user authentication unit 51, a unit code generation unit 52, a power supply control unit 53, an operation judgment unit 54, a periodic data generation unit 55, and a communication unit 56.

A function of the computer 50 as the user authentication unit 51 is to collate the user identification code transmitted from the key unit 11 with the collation source data registered in advance in the non-volatile memory 50M. More specifically, the computer 50 acquires the user identification code received by the receiver 49. Further, the computer 50 collates the acquired user identification code and the authentication source data registered in advance in the non-volatile memory 50M and generates the collation result (success or failure).

A function of the computer 50 as the unit code generation unit 52 is to generate the unit authentication code in response to a request from any of the outboard motor ECUs 30 provided in the outboard motors 3. That is, the outboard ECU 30 provides a unit authentication code request to the immobilizer 10. In response, the unit code generation unit 52 sends the unit authentication code to the inboard LAN 20. The unit authentication code is an authentication code unique to the immobilizer 10. Authentication with respect to the unit authentication code is performed in the outboard motor ECU 30

(function of the unit authentication unit 41). The unit authentication code maybe handled in an encrypted form. In this case, the outboard motor ECU 30 provides the unit authentication code request that includes an encryption key (for example, a random number) to the immobilizer 10. In response, the unit code generation unit 52 sends the unit authentication code encrypted using the encryption key to the inboard LAN 20. In the outboard motor ECU 30, the encrypted unit authentication code is decrypted and the decrypted unit authentication code is collated with the authentication source data.

A function of the computer 50 as the power supply control unit 53 is to control the power supplies to the outboard motors 3 by controlling the power supply relays, etc., provided in the operational panel 8. More specifically, when the unlock signal is received from the key unit 11 and the user authentication succeeds, the computer 50 turns on the power supplies of all of the outboard motors 3. Thereafter, the computer 50 monitors the operation states of the respective outboard motors 3 and when an engine stopped state continues for not less than a predetermined time, turns off the power supply of the corresponding outboard motor 3 under certain conditions.

A function of the computer 50 as the operation judgment unit 54 is to judge the operation states of the respective outboard motors 3. The computer 50 acquires the engine speed information from each outboard motor ECU 30 via the inboard LAN 20 and judges whether or not the engine 31 of each outboard motor 3 is in operation. This judgment result is used for control of power supplies to the respective outboard motors 3 (function of the power supply control unit 53).

A function of the computer 50 as the periodic data generation unit 55 is to generate the periodic data at the fixed period or cycle. The computer 50 generates the periodic data constantly during a term in which it is supplied with power and is operating. The periodic data includes state data that indicate whether the immobilizer 10 is in the locked state or the unlocked state. The state data thus indicate the user authentication result (success or failure) with respect to an unlock operation for releasing the locked state of the immobilizer 10. The periodic data are sent at the fixed period to the inboard LAN by the function of the communication unit 56 to be described next.

A function of the computer 50 as the communication unit 56 is to send various signals to the inboard LAN 20 and acquire various signals from the inboard LAN 20. More specifically, the computer 50 sends the unit authentication code and the periodic data to the inboard LAN 20. Meanwhile, the computer 50 acquires the rotational speed information of the engine 31 of each outboard motor 3 via the inboard LAN 20.

As mentioned above, the key unit 11 includes the lock button 12 and the unlock button 13. The key unit 11 further includes a user authentication code generation unit 60 that is arranged to generate the user authentication code and a transmitter 61. The transmitter 61 is arranged to transmit the lock signal to the immobilizer 10 when the lock button 12 is operated and transmit the unlock signal to the immobilizer 10 when the unlock button 13 is operated. Further, in sending these signals, the transmitter 61 transmits the user authentication code together to the immobilizer 10.

Each remote controller 7 includes a remote controller authentication code generation unit 65. The remote controller authentication code generated by the remote controller authentication code generation unit 65 is transmitted to the outboard motor ECU 30 of the corresponding outboard motor 3 via the control signal line 18. An authentication process using the remote controller authentication code is performed by the computer 40 of the outboard motor ECU 30 (function as the remote controller authentication unit 42).

Each gauge 9 includes a display unit 67, which includes a liquid crystal display panel, etc., and a gauge number setting unit 68. The gauge number setting unit 68 includes, for example, a setting switch. Any one of a plurality of gauge numbers set in advance can be selected and set by operation of the setting switch. Each outboard motor ECU 30 sends the operation state data to the inboard LAN 20 designating, as a destination, the gauge 9 having the gauge number corresponding to the ECU's own equipment identification number. The operation state of the corresponding outboard motor 3 is displayed on the display unit 67 in the gauge 9 that received the operation state data. The displayed operation state includes, for example, information indicating whether or not the engine 31 is in operation and the engine speed information.

By the above-described function of the ID No. setting unit 46, the ID Nos. of the outboard motors 3 are determined in accordance with the order in which the power supplies are turned on in the initial setting process. Thus, by matching the power-on order with the gauge numbers of the gauges 9 in this process, the alignment order of the outboard motors 3 and the display on the respective gauges 9 can be made to correspond to each other. That is, the operation state of the starboard side outboard motor 3S can be made to be displayed on the starboard side gauge 9S located at the right end, the operation state of the central outboard motor 3C can be made to be displayed on the central gauge 9C located at the center, and the operation state of the portside outboard motor 3P can be made to be displayed on the portside gauge 9P located at the left end.

Figure 4:
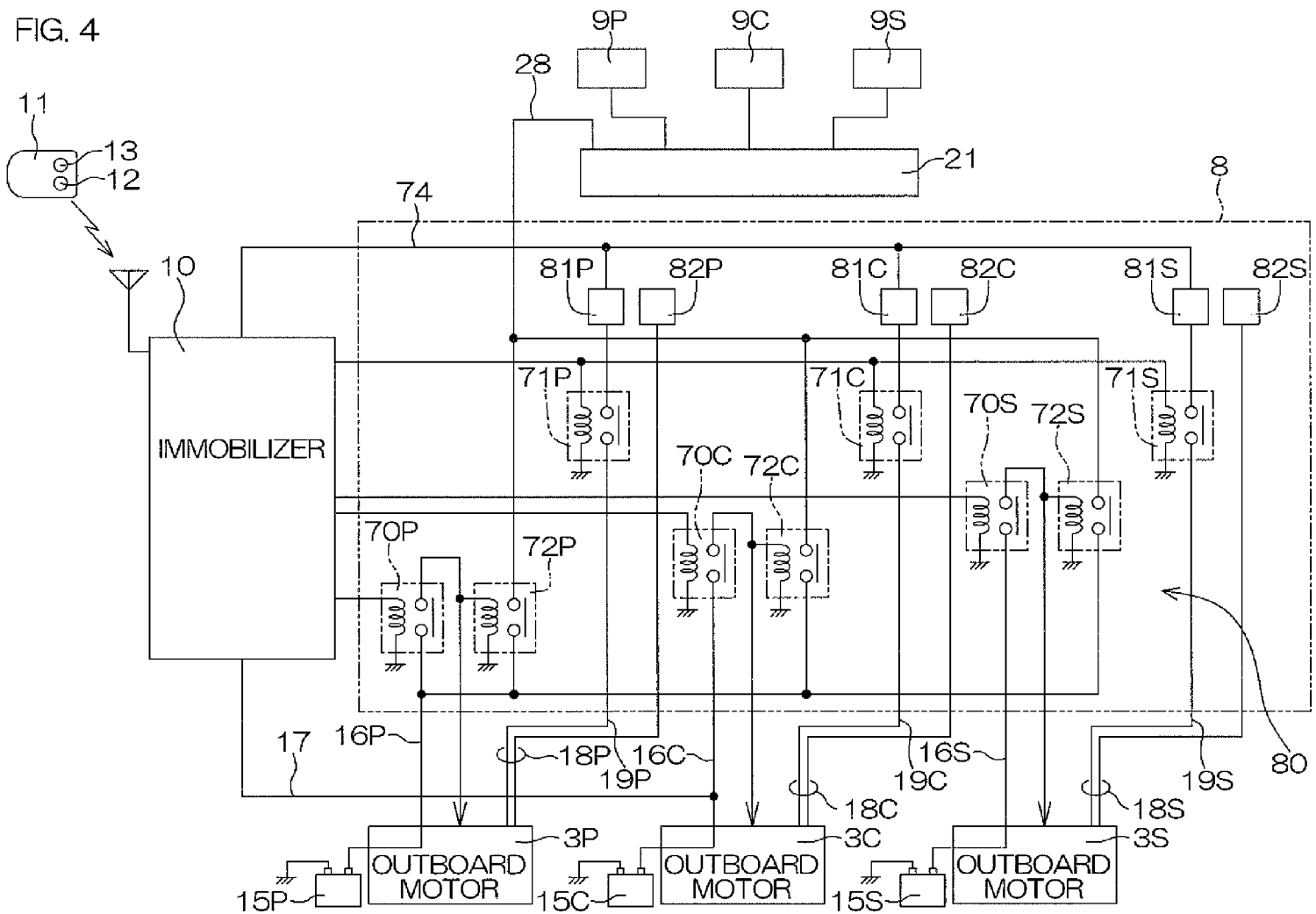
FIG. 4 is a block diagram for explaining a configuration related to power supplies to outboard motors and mainly shows an electrical configuration of an operational panel.

FIG. 4 is a block diagram for explaining a configuration related to the power supplies to the outboard motors 3 and mainly shows an electrical configuration of the operational panel 8. The operational panel 8 includes, in correspondence to the starboard side outboard motor 3S, a start switch 81S, a stop switch 82S, a power supply relay 70S, a start relay 71S, and a switching circuit 72S. Also, the operational panel 8 includes, in correspondence to the central outboard motor 3C, a start switch 81C, a stop switch 82C, a power supply relay 70C, a start relay 71C, and a switching circuit 72C. Further, the operational panel 8 includes, in correspondence to the portside outboard motor 3P, a start switch 81P, a stop switch 82P, a power supply relay 70P, a start relay 71P, and a switching circuit 72P. In the description that follows, when the power supply relays 70S, 70C, and 70P are to be referred to collectively, these shall be referred to as the "power supply relays 70." When the start relays 71S, 71C, and 71P are to be referred to collectively, these shall be referred to as the "start relays 71." When the switching circuits 72S, 72C, and 72P are to be referred to collectively, these shall be referred to as the "switching circuits 72."

The power supply relay 70S is connected to the power supply cable 16S from the battery 15S corresponding to the starboard side outboard motor 3S. When the power supply relay 70S is turned on, the power from the battery 15S is supplied to the starboard side outboard motor 3S. Also, the power supply relay 70C is connected to the power supply cable 16C from the battery 15C corresponding to the central outboard motor 3C. When the power supply relay 70C is turned on, the power from the battery 15C is supplied to the central outboard motor 3C. Further, the power supply relay 70P is connected to the power supply cable 16P from the battery 15P corresponding to the portside outboard motor 3P.

When the power supply relay 70P is turned on, the power from the battery 15P is supplied to the portside outboard motor 3P.

The power from the battery 15C, corresponding to the central outboard motor 3C, is always supplied to the immobilizer 10 via the power supply line 17. Upon receiving the unlock signal from the key unit 11 and upon success of the user authentication, the immobilizer 10 turns on all of the power supply relays 70S, 70C, and 70P and thereby turns on the power supplies to all of the three outboard motors 3.

Further, the start relays 71S, 71C, and 71P are provided in correspondence to the start switches 81S, 81C, and 81P, respectively. When the start switch 81S is operated with the start relay 71S being on, a start command is provided from a starting signal line 19S to the outboard motor ECU 30 of the starboard side outboard motor 3S via the control signal line 18S. When the start switch 81C is operated with the start relay 71C being on, the start command is provided from a starting signal line 19C to the outboard motor ECU 30 of the central outboard motor 3C via the control signal line 18C. Likewise, when the start switch 81P is operated with the start relay 71P being on, the start command is provided from a starting signal line 19P to the outboard motor ECU 30 of the portside outboard motor 3P via the control signal line 18P. In response to the start command, each outboard motor ECU 30 supplies electricity to the starter 32 of the corresponding outboard motor 3 and performs cranking of the engine 31.

The start switches 81S, 81C, and 81P are also connected to the immobilizer 10 via a start notification line 74. Thus, when any of the start switches 81S, 81C, and 81P is operated, a start notification is provided to the immobilizer 10 via the start notification line 74. In response to the start notification, the immobilizer 10 turns on all of the power supply relays 70S, 70C, and 70P and thereby turns on the power supplies of the three outboard motors 3.

The stop switches 82S, 82C, and 82P are connected to the control signal lines 18S, 18C, and 18P, respectively. When the stop switch 82S is operated, a stop signal is provided to the outboard motor ECU 30 of the starboard side outboard motor 3S via the control signal line 18S. Also, when the stop switch 82C is operated, the stop signal is provided to the outboard motor ECU 30 of the central outboard motor 3C via the control signal line 18C. Further, when the stop switch 82P is operated, the stop signal is provided to the outboard motor ECU 30 of the portside outboard motor 3P via the control signal line 18P. Upon receiving the stop signal, the outboard motor ECU 30 stops the engine 31 of the corresponding outboard motor 3. More specifically, the fuel supply control and the ignition control are stopped.

The system power supply circuit 80 arranged to supply the system power to the inboard LAN 20 is provided inside the operational panel 8. The system power supply circuit 80 includes the three switching circuits 72S, 72C, and 72P, which are connected in parallel. In the present preferred embodiment, the switching circuits 72S, 72C, and 72P includes relays. One end of the system power supply circuit 80 is connected to the power supply cable 16P from the portside outboard motor 3P and the other end is connected to the stem side hub 21 via the system power supply line 28.

The switching circuits 72S, 72C and 72P operate so as to maintain the connection between the power supply cable 16S and the system power supply line 28 in a state where the power supply of at least one of the outboard motors 3 is turned on. More specifically, the switching circuit 72S is on when the power supply relay 70S is in the on state and is off when the power supply relay 70S is in the off state. Also, the switching circuit 72C is on when the power supply relay 70C is in the on state and is off when the power supply relay 70C is in the off state. Further, the switching circuit 72P is on when the power supply relay 70P is in the on state and is off when the power supply relay 70P is in the off state.

When power is supplied to the system power supply line 28, the gauges 9 that are connected to the stem side hub 21 are put in the operating state. Thus, if a gauge 9 is in the operating state, a user can recognize that the power supply of any of the outboard motors 3 is on.

FIG. 5 is a time chart for explaining operations related to power supply control of the outboard motors 3.

In FIGS. 5, (*a*) and (*b*) show operations of the key unit 11 as an immobilizer transmitter. More specifically, (*a*) shows an operation of the lock button 12 (LOCK), and (*b*) shows an operation of the unlock button 13 (UNLOCK).

In FIGS. 5, (*c*) and (*d*) show operations of the immobilizer 10 as an immobilizer receiver. Specifically, (*c*) shows an operation state of the immobilizer 10, and (*d*) shows a result (LOCK state) of the user authentication.

In FIG. 5, (*e*) to (*o*) show operations of the operational panel 8. Specifically, (*e*) shows states of the start relays 71S, 71C, and 71P, (*f*) shows the signal provided to the start notification line 74, and (*g*), (*h*) and (*i*) show the states of the power supply relays 70S, 70C, and 70P, respectively. In addition, (*j*), (*l*) and (*n*) show operations of the start switches 81S, 81C, and 81P, respectively, and (*k*), (*m*) and (*o*) show operations of the stop switches 82S, 82C, and 82P, respectively.

In FIG. 5, (*p*) to (*u*) show states of the outboard motors 3S, 3C, and 3P. Specifically, (p) shows a result of the unit authentication process (authentication state) in the outboard motor ECU 30 of the starboard side outboard motor 3S, and (*q*) shows states (operating/stopped) of the engine 31 of the starboard side outboard motor 3S. Also, (*r*) shows a result of the unit authentication process (authentication state) in the outboard motor ECU 30 of the central outboard motor 3C, and (*s*) shows states (operating/stopped) of the engine 31 of the central outboard motor 3C. Further, (*t*) shows a result of the unit authentication process (authentication state) in the outboard motor ECU 30 of the portside outboard motor 3P, and (*u*) shows states (operating/stopped) of the engine 31 of the portside outboard motor 3P.

In a period before the unlock button 13 of the key unit 11 is operated, the immobilizer 10 is in a sleep mode, which is a power saving mode. In this mode, both the start relays 71 and the power supply relays 70 are off and all switching circuits 72 are in the off state. All of the outboard motor ECUs 30 are thus in the power-off state and the system power supply for the inboard LAN 20 is also in the off state. Therefore, all of the gauges 9 are thus in the off state.

When the unlock button 13 of the key unit 11 is operated (time t1), the key unit 11 sends the unlock signal along with the user authentication code. These are received by the immobilizer 10. The computer 50 of the immobilizer 10 executes the authentication process on the received user authentication code (function as the user authentication unit 51), and if the authentication succeeds, the operation mode is switched from the sleep mode to the wakeup mode, which is the ordinary mode. Then, the state data expressing the user authentication state is changed from "locked" (non-authenticated) to "unlocked" (authenticated). Further, the immobilizer 10 sends the unit authentication code to the outboard motor ECUs 30 of the respective outboard motors 3 via the inboard LAN 20. The immobilizer 10 also includes the state data that express the user authentication state (locked or unlocked) in the periodic data and sends the data to the outboard motor ECUs 30 of the respective outboard motors 3 via the inboard LAN 20.

Each outboard motor ECU 30 requests the immobilizer 10 to send the unit authentication code, and executes the authentication process on the unit authentication code that is sent from the immobilizer 10 in response to the request. If the authentication of the unit authentication code succeeds and the state data of the immobilizer 10 indicate the "unlocked" state, the authentication state is changed from "non-authenticated" to "authenticated."

In changing the user authentication state from "locked" to "unlocked," the immobilizer 10 turns on all the start relays 71 and further turns on all the power supply relays 70. The power supplies of all outboard motors 3 are thereby turned on and all of the gauges 9 are put in the on state.

When in this state, the start switch 81S, corresponding to the starboard side outboard motor 3S, is operated in the operational panel 8 (time t2), the start notification is sent to the start notification line 74. Also, the start command is sent from the start signal line 19S to the outboard motor ECU 30 of the starboard outboard motor 3S via the control signal line 18S. In response, electricity is supplied to the starter 32 of the starboard side outboard motor 3S, and further, the fuel supply control and the ignition control is performed, whereby the engine 3 is started.

When any of the power supply relays 70 is on, the computer 50 of the immobilizer 10 monitors the operation state of the engine 31 in the corresponding outboard motor 3. The computer 50 then measures the duration of the state in which each power supply relay 70 is in the on state and the engine 31 of the corresponding outboard motor 3 is stopped (standby state). When the standby state duration reaches a predetermined time T (for example, 600 milliseconds) that has been determined in advance, the computer 50 turns off the power supply relay 70 of the corresponding outboard motor 3 under a certain condition (time t3). At the outboard motor ECU 30 of the outboard motor 3 for which the power supply is turned off, the authentication state becomes "non-authenticated."

The certain condition may be that at least one of the conditions A, B, and C, described below, is met.

Condition A: The engine of another outboard motor is in operation.

Condition B: The on state of another power supply relay 70 is continued (the predetermined time T has not elapsed for this power supply relay).

Condition C: A turn-off priority order is higher (a turn-on priority order is lower) than that of another power supply relay in the on state.

When Condition A is met, the supply of the system power can be continued because another power supply relay 70 is held in the on state and the corresponding switching circuit 72 is thus held in the on state. Because Condition B is met as long as Condition A is met, just Condition B may be monitored without monitoring Condition A.

Condition C is a condition that applies when the engines 31 of all of the outboard motors 3 are in the stopped state. For example, if none of the start switches 81 is operated until the elapse of the predetermined time T from the point at which the three power supply relays 70 are put in the on state, the predetermined time T is reached simultaneously for the three power supply relays 70. In this case, whether or not to turn off each power supply relay 70 is determined in accordance with the turn-off priority order. That is, when the predetermined time T is reached simultaneously for the plurality of outboard motors 3, the turning off of a certain power supply relay 70 is allowed if the power supply relay 70 corresponding to an outboard motor 3 of lower turn-off priority order is on.

For example, the turn-off priority order is set in advance in the order of: portside outboard motor 3P→central outboard motor 3C→starboard side outboard motor 3S. Also for example, the power supply relay 70S is already in the off state and the predetermined time T has elapsed simultaneously for both the power supply relays 70P and 70C. In this case, the computer 50 of the immobilizer 10 turns off the power supply relay 70P corresponding to the portside outboard motor 3P and holds the power supply relay 70C, corresponding to the central outboard motor 3C, in the on state.

When the start switch 18C, corresponding to the central outboard motor 3C, is operated (time t4), the start notification is sent to the start notification line 74 and the start command is sent to the start signal line 19C. The computer 50 of the immobilizer 10 thus turns on all the power supply relays 70. In the central outboard motor 3C, corresponding to the start switch 81C, the outboard motor ECU 30 supplies electricity to the starter 32 and performs the fuel supply control and the ignition control to start the engine 31. By all of the power supply relays 70 being on, the unit authentication process is performed and the authentication state is changed to "authenticated" in the central outboard motor 3C and the portside outboard motor 3P.

When in this state, the predetermined time T elapses, the power supply relay 70P, corresponding to the portside outboard motor 3P with which the engine 31 is in the stopped state, is turned off (time t5). Therefore, the authentication state in the outboard motor ECU 30 of the portside outboard motor 3P thus changes to "non-authenticated."

When the stop switch 82S, corresponding to the starboard side outboard motor 3S, is operated thereafter (time t6), the stop signal is sent from the control signal line 18S to the outboard motor ECU 30 of the starboard side outboard motor 3S. The outboard motor ECU 30 thus stops the fuel supply control and the ignition control to stop the engine 31 of the starboard side outboard motor 3S.

When the stop switch 82C, corresponding to the central outboard motor 3C, is operated furthermore thereafter (time t7), the stop signal is sent from the control signal line 18S to the outboard motor ECU 30 of the central outboard motor 3C. The outboard motor ECU 30 thus stops the fuel supply control and the ignition control to stop the engine 31 of the central outboard motor 3C.

When the predetermined time T elapses from the stoppage of the engine of the starboard side outboard motor 3S, the power supply relay 70S, corresponding to the starboard side outboard motor 3S, is turned off (time t8). The turning off of the power supply relay 70S is enabled because the on state of another power supply relay 70C is continued and the Condition B is thus met. That is, the power supply relay 70C, corresponding to the central outboard motor 3C, is held in the on state and the power supply from the switching circuit 72C to the system power supply line 28 is secured. In the period in which just the power supply relay 70C is on singularly, the power supply relay 70C is held in the on state even when the predetermined time T elapses.

When the lock button 12 of the key unit 11 is operated in the state where the engines 31 of all outboard motors 3 are stopped (time t9), the key unit 11 sends the user authentication code along with the lock signal. The immobilizer 10 executes the user authentication process and if the authentication process succeeds, turns off all start relays 71 and all power supply relays 70. However, this process is executed if the engines 31 of all outboard motors 3 are stopped.

At least one of the power supply relays 70 is thus held in the on state when the immobilizer 10 is in the unlocked state, and power is thus supplied from at least one of the switching circuits 72 to the system power supply line 28. The gauges 9 are thus held in the on state when the immobilizer 10 is in the unlocked state. The user can thus immediately know from the displays of the gauges 9 that the immobilizer 10 is in the unlocked state. The user is thus prevented from leaving the marine vessel 1 with the immobilizer 10 remaining in the unlocked state, and the theft deterrent effect can thus be improved.

When the lock button 12 is operated in a period in which the engine 31 of at least one of the outboard motors 3 is in operation (time t10), the immobilizer 10 ignores such a lock operation. Also, when the unlock button 13 is operated in the unlocked state (t11), the immobilizer 10 ignores the operation. However, when the unlock operation is performed from the key unit 11 in the state where the engines 31 of all outboard motors 3 are stopped, the operation may accepted and a control of turning on all power supply relays 70 may be performed.

Figure 6:
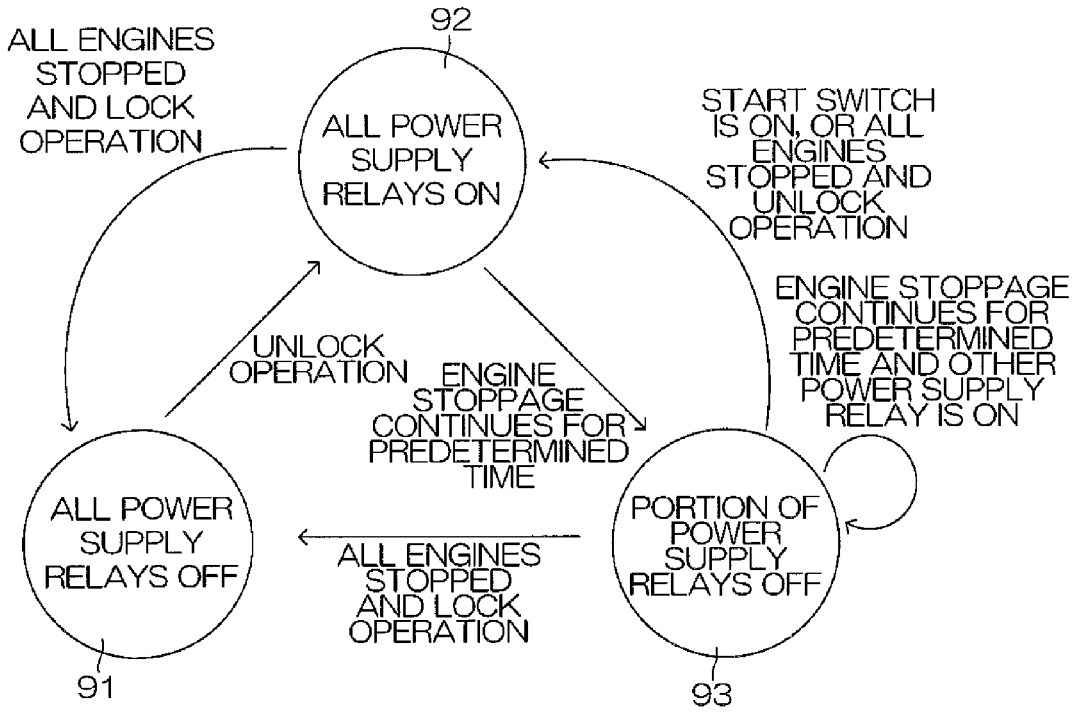
FIG. 6 is a state transition diagram of the power supply control.

FIG. 6 is a state transition diagram of the power supply control. In an initial state 91, all the power supply relays 70 are in the off state and all the engines 31 are stopped. When from this state, the unlock operation is performed by the key unit 11, all the power relays are turned on, an all-on state 92 is entered, and the power supplies of all the outboard motors 3 are turned on if the user authentication process and the unit authentication process are successful. When in the all-on state 92, the lock operation is performed by the key unit 11, all the power supply relays 70 are turned off and transition into the initial state 91 is performed if all engines 31 are in the stopped state.

On the other hand, when in the all-on state 92, the continuation of the engine stopped state of not less than the predetermined time T is detected for any of the outboard motors 3, the power supply relay 70 corresponding to the applicable outboard motor 3 is turned off and transition into a power saving state 93 is performed. When in the power saving state 93, the continuation of the engine stopped state of not less than the predetermined time T is further detected for a different outboard motor 3, the power supply relay 70 corresponding to the applicable outboard motor 3 is turned off. However, this is performed if another power supply relay in which the on state is continued exists or a power supply relay of lower turn-off priority order exists. The power saving state 93 is thus continued.

When in the power saving state 93, any of the start switches 81 is operated, all the power supply relays 70 are turned on and transition into the all-on state 92 is performed. Arrangements can also be made such that transition from the power saving state 93 to the all-on state 92 is performed when the unlock operation is performed from the key unit 11 in the state where the engines 31 of all the outboard motors 3 are stopped.

Thus, with the present preferred embodiment, the power supplies of all the three outboard motors 3 can be turned on all at once when the unlock button 13 of the key unit 11 is operated. The power-on operation is thus simple. Meanwhile, when the engine stopped state is continued for not less than the predetermined time, the corresponding power supply relay 70 is turned off under the certain condition. The energy saving property can thereby be improved and running out of power of the batteries can be suppressed or prevented. Moreover, the power supply relay 70 is automatically turned on when the start switch 81 is operated and the power-on operation thus does not have to be performed again. Excellent operability can thus be secured.

Figure 7:
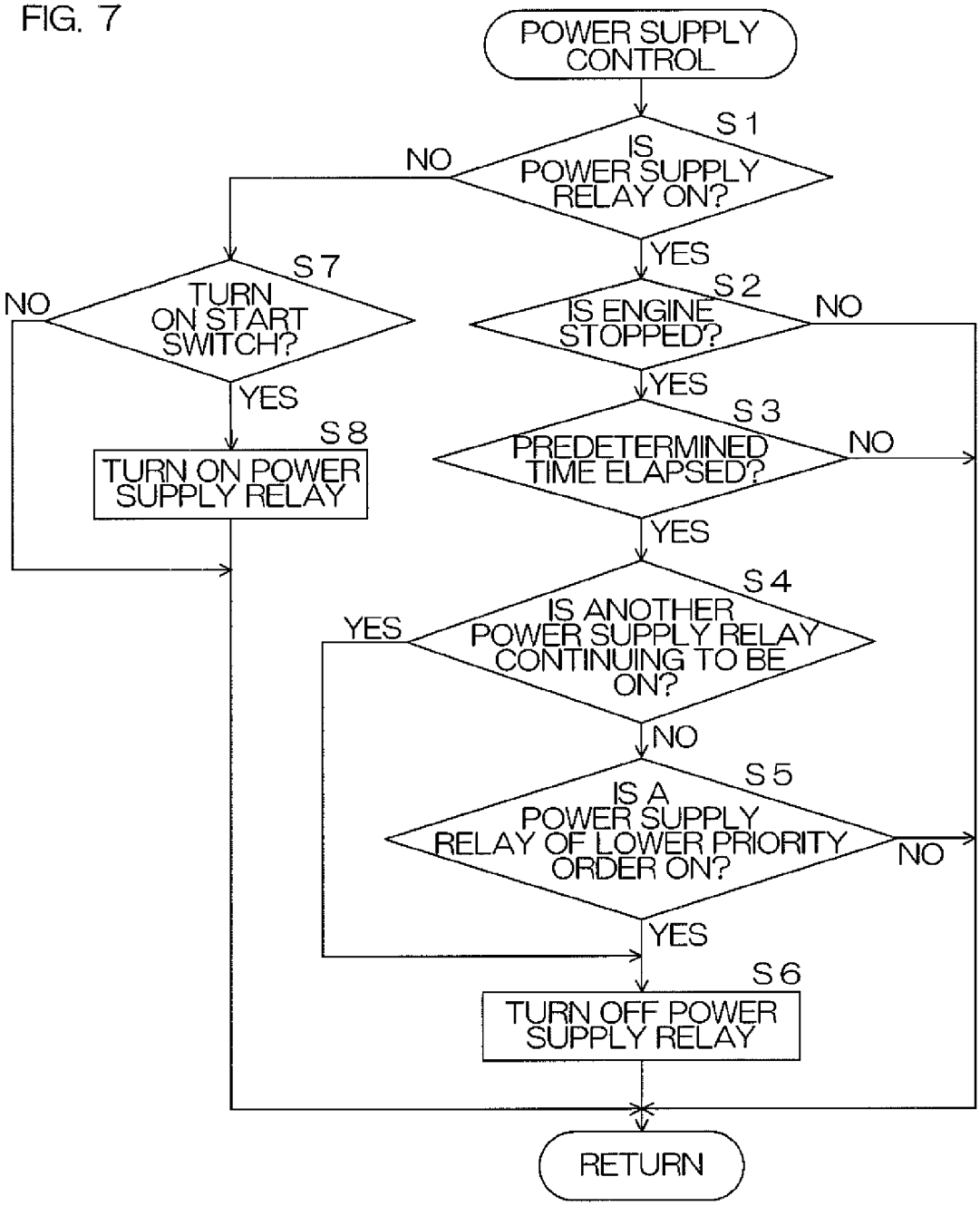
FIG. 7 is a flowchart for explaining contents of the power supply control.

FIG. 7 is a flowchart for explaining the power supply control that is executed by the computer 50 of the immobilizer 10 in correspondence to the respective outboard motors 3 (function as the power supply control unit 53). Although the control related to the power supply relay 70S shall now be described as an example, the same applies to the control related to the other power supply relays 70C and 70P. The present control is executed repeatedly at a predetermined control period (for example, a period of about 10 milliseconds).

First, the computer 50 determines whether or not the power supply relay 70S is on (step S1). If the power supply relay 70S is on (step S1: YES), the computer 50 determines whether or not the engine 31 of the corresponding outboard motor 3S is stopped (step S2). If the engine 31 is stopped (step S2: YES), the computer 50 determines whether or not the engine stopped state is continued for the predetermined time T (step S3). If the engine stopped state is continued for the predetermined time T (step S3: YES), the computer 50 determines whether or not another power supply relay 70 in which the on state is continued (that is, for which the predetermined time T has not elapsed) exists (step S4). If another power supply relay 70 in which the on state is continued exists (step S4: YES), the computer 50 turns off the power supply relay 70S (step S6). If another power supply relay 70 in which the on state is continued does not exist (step S4: NO), the computer 50 judges whether or not a power supply relay 70 of lower turn-off priority order than the power supply relay 70S (and for which the predetermined time T is reached simultaneously) is in the on state (step S5). If the another power supply relay 70 of lower turn-off priority order is on (step S5: YES), the computer 50 turns off the power supply relay 70S (step S6).

The determination in step S4 is negated (NO) in the case where only the power supply relay subject to the determination is on and in the case where the predetermined time T has elapsed simultaneously not only for the power supply relay (in the on state) subject to the determination but has also elapsed simultaneously at another power supply relay (in the on state).

When the determination at any of the steps S2, S3, and S5 is negated, the power supply relay 70S is held in the on state.

On the other hand, when the power supply relay 70S is in the off state, it is determined whether any of the start switches 81 is operated, that is, whether or not the start notification is input from the start notification line 74 (step S7). When the start notification is provided (step S7: YES), the power supply relay 70S is turned on (step S8) or otherwise (step S7: NO) the power supply relay 70S is held in the off state.

Figure 8:
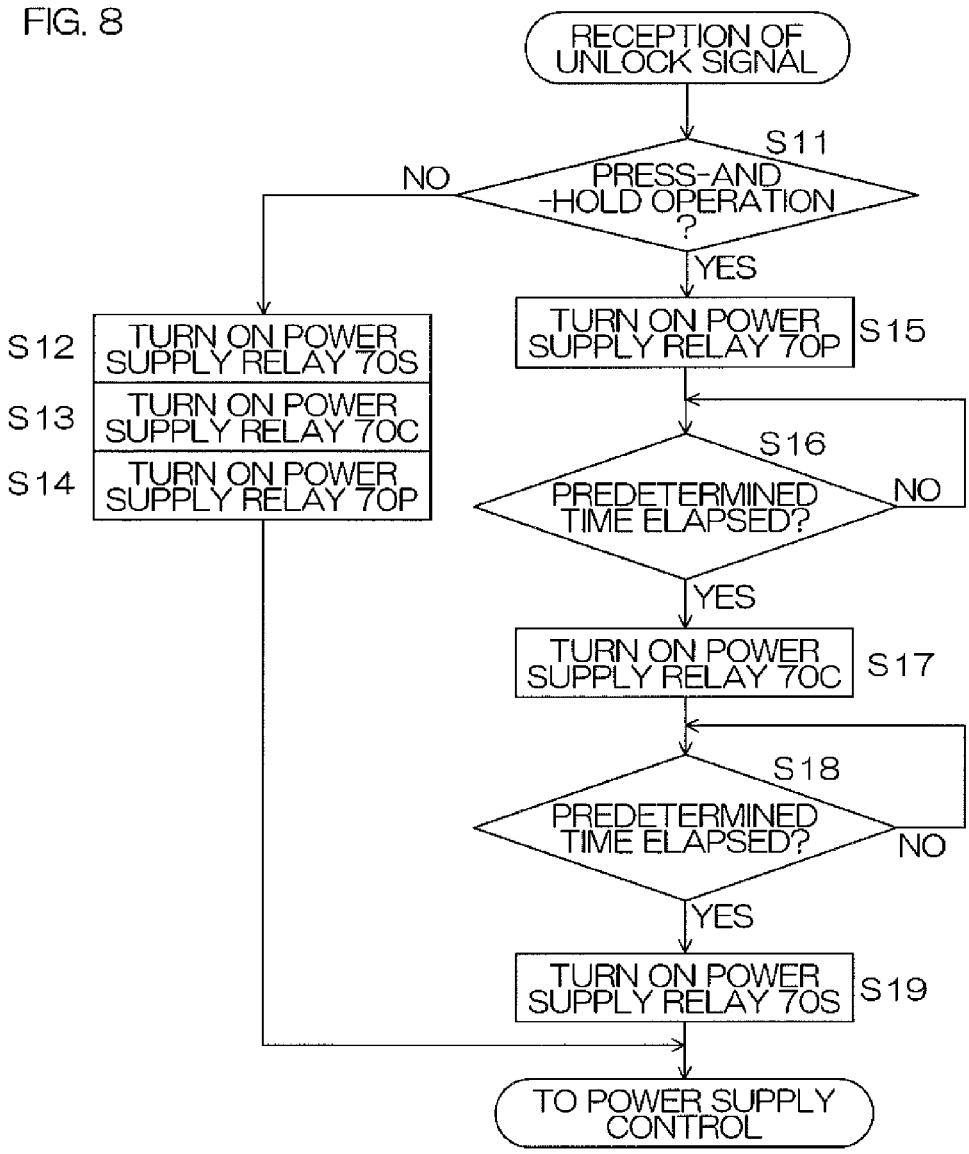
FIG. 8 is a flowchart for explaining contents of power-on control.

FIG. 8 is a flowchart for explaining contents of the power-on control executed by the immobilizer 10 in response to the unlock operation from the key unit 11. The computer 50 of the immobilizer 10 classifies the operation of the unlock button 13 into two types according to the operation time. That is, if the operation time of the unlock button 13 continues for not less than a predetermined time (for example, 4 seconds), this is deemed to be a "press-and-hold operation" and is distinguished from an operation (hereinafter referred to as a "press-and-release operation") that lasts less than the predetermined time.

If the computer 50 receives a signal from the key unit 11 when all power supply relays 70 are in the off state, the computer 50 determines whether the press-and-hold operation is performed (step S11). In the case of the press-and-release operation (step S11: NO), the computer 50 turns on all power supply relays 70 simultaneously (steps S12, S13, S14). On the other hand, when the press-and-hold operation is performed (step S11: YES), the computer 50 turns on the three power supply relays 70 successively in accordance with a predetermined order and with a predetermined time interval (for example, a 2 second interval) in between. For example, the computer 50 first turns on the power supply relay 70P (step S15). Thereafter, the computer 50 waits for the elapse of the predetermined time (step S16) and then turns on the power supply relay 70C (step S17). Thereafter, the computer 50 waits for the further elapse of the predetermined time (step S18) and then turns on the power supply relay 70S (step S19).

Figure 9:
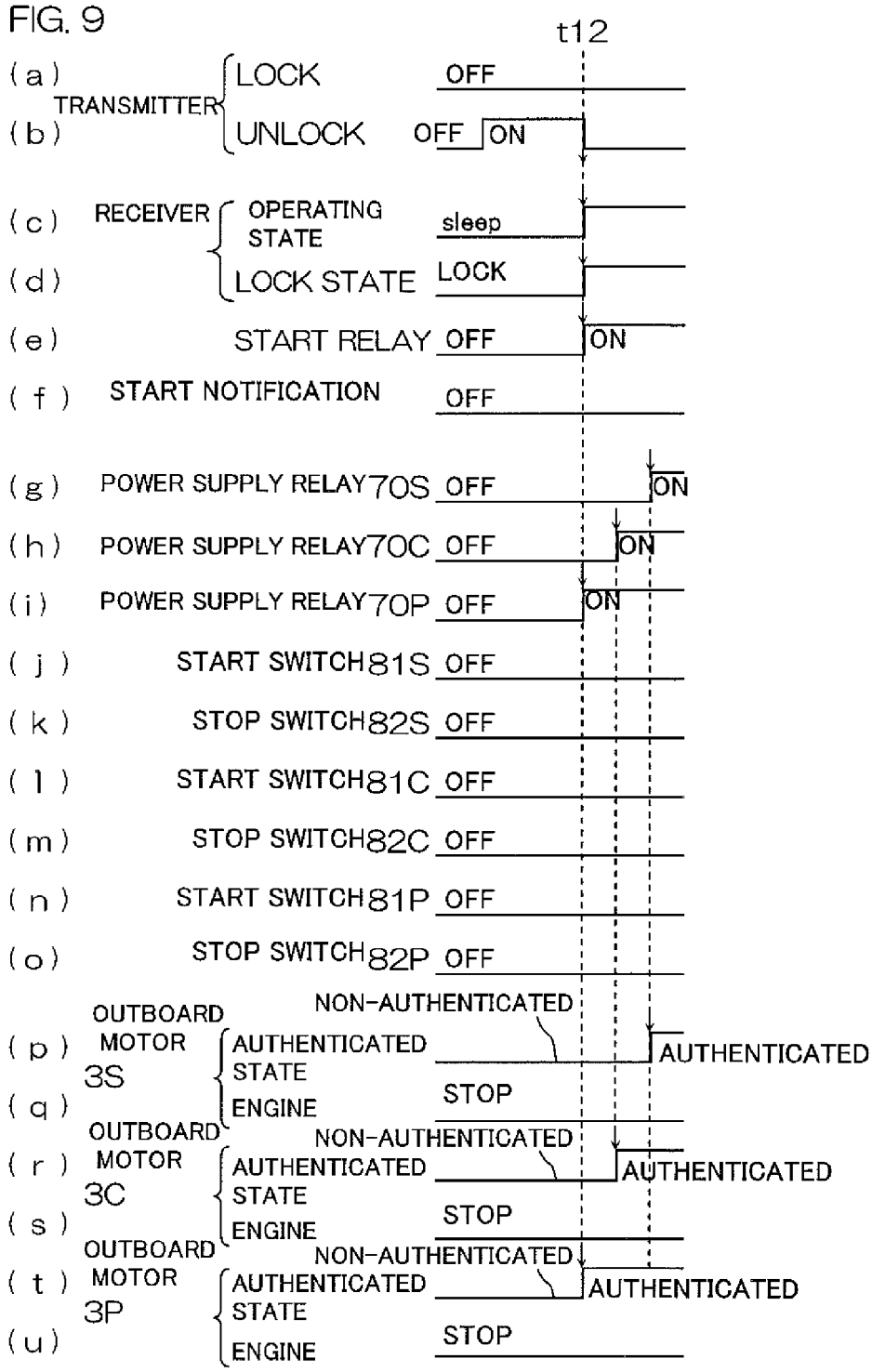
FIG. 9 is a time chart for explaining operations performed when a press-and-hold operation of the unlock button is performed.

FIG. 9 is a time chart for explaining the operations performed when the press-and-hold operation of the unlock button 13 is performed. In FIG. 9, (*a*) to (*u*) correspond to (*a*) to (*u*) in FIG. 5, respectively.

When the press-and-hold operation of the unlock button 13 is detected (time t12), the power supply relays 70P, 70C, and 70S are turned on successively with the predetermined time interval in between. Accordingly, the power supplies of the outboard motors 3P, 3C, and 3S are turned on successively.

By the power supplies of the outboard motors 3S, 3C, and 3P being turned on successively with the time interval in between, the ID No. setting process, to be described next, can be performed smoothly.

Figure 10:
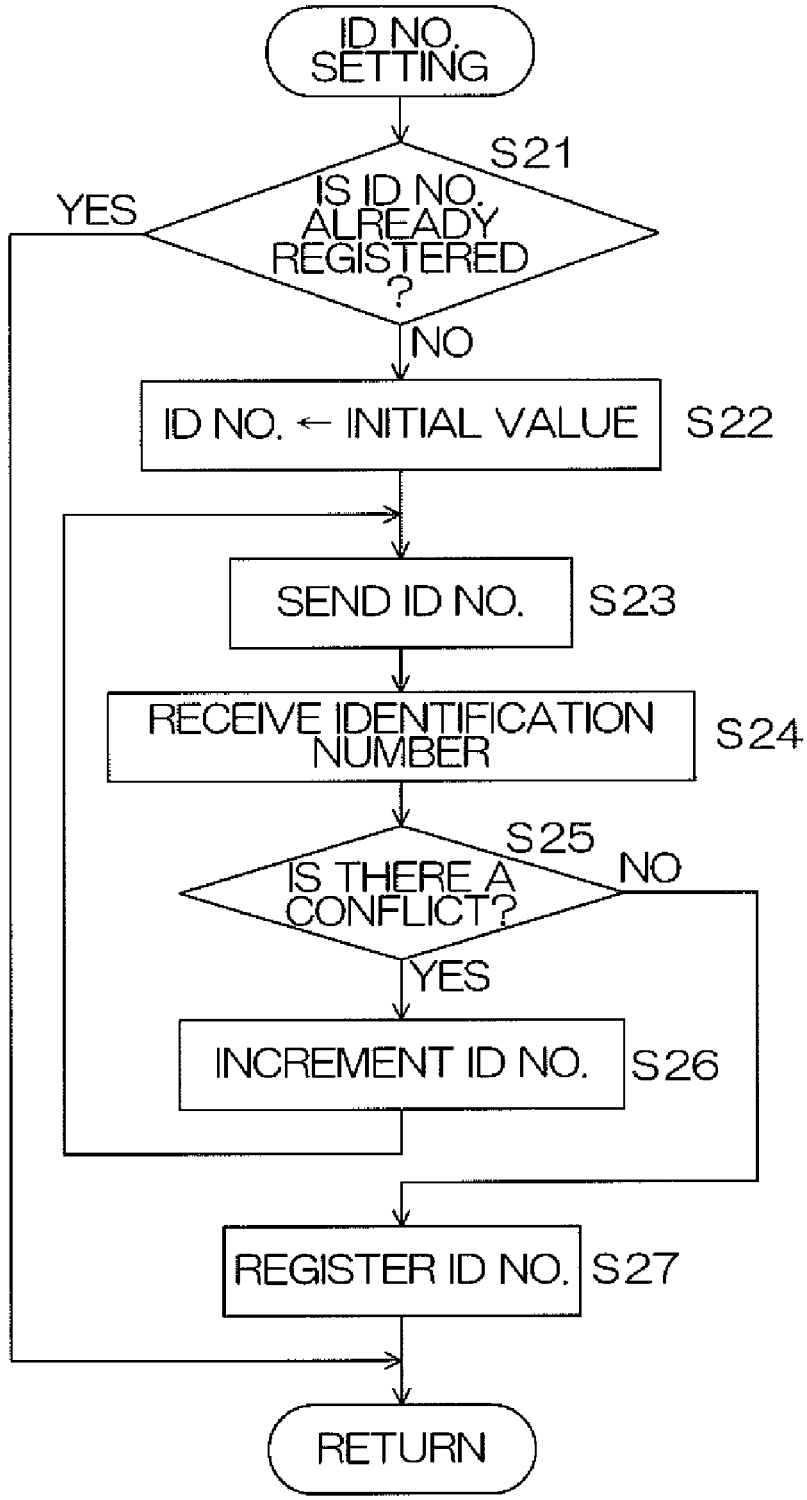
FIG. 10 is a flowchart for explaining an ID No. setting process.

FIG. 10 is a flowchart for explaining the ID No. setting process performed by the outboard motor ECU 30 of each outboard motor 3 (function of the computer 40 as the ID No. setting unit 46). When the power supply is turned on, the computer 40 of the outboard motor ECU 30 references the non-volatile memory 40M and determines whether or not the ID No. of the corresponding outboard motor 3 is already registered (step S21). If the ID No. is already registered (step S21: YES), the computer 40 does not perform the subsequent process. If the ID No. is not registered (step S21: NO), the computer 40 sets its own ID No. to an initial value (for example, "1") that has been determined in advance (step S22) and sends this ID No. to the inboard LAN 20 (step S23). At the same time, the computer 40 monitors the identification numbers (device instance numbers) sent from other equipments to the inboard LAN 20 (step S24), and determines whether or not there is a conflict with the ID No. sent by the computer itself (step S25). Here, "conflict" means that the same identification number as the ID No. sent by the computer itself exists on the inboard LAN 20.

If a conflict of the ID No. is detected (step S25: YES), the computer 40 sets a new ID No. by incrementing its own ID No. by "+1" (step S26), and then repeats the process from step S23. The computer 40 repeats this operation until a conflict of the ID No. is no longer detected. When a conflict of the ID No. is no longer detected (step S25: NO), the computer 40 registers the ID No. at that time into the non-volatile memory 40M (step S27). The ID No. of the outboard motor 3 is thus determined.

If such an ID No. setting process occurs simultaneously in the plurality of outboard motors 3, the ID Nos. may be incremented simultaneously in the outboard motor ECUs 30 of the outboard motors 3 and thus the conflict of the ID No. may be repeated on the inboard LAN 20. The ID Nos. of the respective outboard motors 3 thus could not be set smoothly.

In the present preferred embodiment, on the other hand, when the press-and-hold operation of the unlock button 13 of the key unit 11 is performed, the power supplies of the outboard motors 3P, 3C, and 3S are turned on successively with the time interval in between. By this process, the ID No. (for example, "1") of the outboard motor 3P for which the power supply is turned on first is determined first, the ID No. (for example, "2") of the outboard motor 3C for which the power supply is turned on next is determined next, and the ID No. (for example, "3") of the outboard motor 3S for which the power supply is turned on next is determined next. The ID No. setting process can thus be performed smoothly while avoiding the conflict of the ID No. on the inboard LAN 20.

It suffices that the ID No. setting process be performed just once as an initial setting after installation of the outboard motors 3 and other necessary equipments on the hull 2 and connecting all the necessary equipments to the inboard LAN 20. Each ID No. that is set is registered in the non-volatile memory 40M of the outboard motor ECU 30 of the corresponding outboard motor 3, and thereafter, the identification of the outboard motor ECU 30 on the inboard LAN 20 is performed using the registered ID No.

The ID Nos. assigned to the plurality of outboard motors 3 can be known in advance because the ID Nos. of the respective outboard motors 3 are set in the order in which the power supplies are turned on. Association of each outboard motor 3 with a gauge 9 is thus facilitated. That is, by matching the power-on order of the outboard motors 3 with the gauge numbers of the gauges 9, the order of alignment of the outboard motors 3 and the displays on the respective gauges 9 can be made to correspond to each other.

While a preferred embodiment of the present invention has thus been described, the present invention may be embodied in many other ways. For example, although in the preferred embodiment described above, the mechanical remote controller 7, with which the operation of the lever 7*a* is transmitted mechanically by a cable to the outboard motor 3, is preferably used, an electric remote controller may be used instead. An electric remote controller includes a position sensor that detects the lever position and sends an output signal of the position sensor to the outboard motor ECU. The outboard motor ECU controls the shift position and the engine speed of the outboard motor in accordance with the signal from the position sensor. In such a case, an ECU is included in the remote controller (remote controller ECU), and the unit authentication process for authentication of the unit authentication code sent by the immobilizer 10 may be performed by the remote controller ECU. The outboard motor ECU thus makes the outboard motor 3 operate if the following conditions are satisfied: the success of unlocking by the user authentication by the immobilizer 10, the success of the unit authentication by the remote controller ECU, and the success of the remote controller authentication by the outboard motor ECU.

Also, although in the above-described preferred embodiment, the control of successively turning on the power supplies of the plurality of outboard motors 3 preferably is started in response to the press-and-hold operation of the unlock button 13 of the key unit 11, such control may be performed in response to another operation. For example, the control of successively turning on the power supplies of the outboard motors 3 may be started in response to simultaneous operation of the lock button 12 and the unlock button 13.

Also, although in the above-described preferred embodiment, all the power supply relays 70 are turned on in response to the operation of any of the start switches 81, just the power supply relay 70 corresponding to the start switch 81 that is operated may be turned on instead.

Further, although with the above-described preferred embodiment, the marine vessel propulsion system having the immobilizer 10 has been described as an example, the present invention can be applied to a system that does not have an immobilizer. That is, the present invention can also be applied to a marine vessel propulsion system in which the turning on of power to the plurality of outboard motors 3 is performed all at once in response to a key switch that is operable by a key carried by the user.

Also, although in the preferred embodiment described above, the outboard motor is described as an example of the propulsion device, the present invention can be applied to marine vessel propulsion system using propulsion devices of other forms. Other examples of the propulsion device include an inboard/outboard motor (a stern drive or an inboard motor/outboard drive), an inboard motor, and a water jet drive. The outboard motor includes a propulsion unit provided outboard of the vessel and having a motor and a propulsive force generating member (propeller), and a steering mechanism, which horizontally turns the entire propulsion unit with respect to the hull. The inboard/outboard motor includes a motor provided inboard of the vessel, and a drive unit provided outboard and having a propulsive force generating member and a steering mechanism. The inboard motor includes a motor and a drive unit incorporated in the hull, and a propeller shaft extending outboard from the drive unit. In this case, a steering mechanism is separately provided. The water jet drive has a configuration such that water sucked from the bottom of the marine vessel is accelerated by a pump and ejected from an ejection nozzle provided at the stern of the marine vessel to obtain a propulsive force. In this case, the steering mechanism includes the ejection nozzle and a mechanism for turning the ejection nozzle in a horizontal plane.

Various other design changes can be made within the scope of the claims.

A non-limiting example of correspondence between claim terms and the terms used in the above description of the preferred embodiments is shown below:

propulsion device: outboard motor 3 switching unit: power supply relay 70 operation judgment unit: operation determination unit 54 and step S2 of FIG. 7 power supply control unit: power supply control unit 53, steps S1 to S8 of FIG. 7, and steps S11 to S19 of FIG. 8 start command unit: start switch 81 operational unit: key unit 11

While the present invention has been described in detail by way of the preferred embodiments thereof, it should be understood that these preferred embodiments are merely illustrative of the technical principles of the present invention but not limitative of the present invention. The spirit and scope of the present invention are to be limited only by the appended claims.

This application corresponds to Japanese Patent Application No. 2008-214382 filed in the Japanese Patent Office on Aug. 22, 2008, the whole disclosure of which is incorporated herein by reference.

What is claimed is:

1. A marine vessel power supply system arranged to supply power to a plurality of propulsion devices each provided with an engine, the marine vessel power supply system comprising:

a plurality of switching units arranged to turn on and off power supplies to the propulsion devices individually;

an operation judgment unit arranged to judge whether the engine of each propulsion device is in an operating state or in a stopped state; and a power supply control unit arranged to turn off a switching unit of the plurality of the switching units when the switching unit is in an on state and if the engine of the propulsion device corresponding to the switching unit is in a stopped state for not less than a predetermined time; wherein a priority order is set in advance of turning off of the power supplies of the plurality of propulsion devices, and the power supply control unit is arranged to turn off the switching units when the switching units are in the on state, in accordance with the priority order if the engines of all the propulsion devices in a power supplied state are all in the stopped state for not less than the predetermined time.

2. A marine vessel power supply system arranged to supply power to a plurality of propulsion devices each provided with an engine, the marine vessel power supply system comprising:

a plurality of switching units arranged to turn on and off power supplies to the propulsion devices individually;

an operation judgment unit arranged to judge whether the engine of each propulsion device is in an operating state or in a stopped state;

a power supply control unit arranged to turn off a switching unit of the plurality of the switching units when the switching unit is in an on state and if the engine of the propulsion device corresponding to the switching unit is in a stopped state for not less than a predetermined time; and a start command unit arranged to generate a start command for commanding starting of the engine, wherein the power supply control unit is arranged to control a switching unit of the plurality of the switching units to be in the on state when the switching unit is in an off state and in response to the generation of the start command by the start command unit.

3. A marine vessel power supply system arranged to supply power to a plurality of propulsion devices each provided with an engine, the marine vessel power supply system comprising:

a plurality of switching units arranged to turn on and off power supplies to the propulsion devices individually;

an operation judgment unit arranged to judge whether the engine of each propulsion device is in an operating state or in a stopped state;

a power supply control unit arranged to turn off a switching unit of the plurality of the switching units when the switching unit is in an on state and if the engine of the propulsion device corresponding to the switching unit is in a stopped state for not less than a predetermined time; and an operational unit arranged to be operated by a user to turn on the power supplies, wherein the power supply control unit is arranged to put the plurality of switching units in the on state successively in an order determined in advance and in response to a predetermined power-on operation on the operational unit.

4. A marine vessel comprising:

a hull;

a plurality of propulsion devices attached to the hull and each provided with an engine;

a plurality of switching units arranged to turn on and off power supplies to the propulsion devices individually;

an operation judgment unit arranged to judge whether the engine of each propulsion device is in an operating state or in a stopped state;

an operational unit arranged to be operated by a user to turn on the power supplies; and a power supply control unit arranged to turn on each of the plurality of switching units in response to a power-on operation of the operational unit, and arranged to turn off a switching unit of the plurality of the switching units when a switching unit is in an on state and if the engine of the propulsion device corresponding to the switching unit is in a stopped state for not less than a predetermined time; wherein the power supply control unit is arranged to turn off a switching unit of the plurality of the switching units when a switching unit is in the on state and if the engine of the propulsion device corresponding to the switching unit is in the stopped state for not less than the predetermined time and the power supply to at least one of the propulsion devices not corresponding to the switching unit is continued.

5. A marine vessel comprising:

a hull;

a plurality of propulsion devices attached to the hull and each provided with an engine;

a plurality of switching units arranged to turn on and off power supplies to the propulsion devices individually;

an operation judgment unit arranged to judge whether the engine of each propulsion device is in an operating state or in a stopped state;

an operational unit arranged to be operated by a user to turn on the power supplies; and a power supply control unit arranged to turn on each of the plurality of switching units in response to a power-on operation of the operational unit, and arranged to turn off a switching unit of the plurality of the switching units when a switching unit is in an on state and if the engine of the propulsion device corresponding to the switching unit is in a stopped state for not less than a predetermined time; wherein a priority order is set in advance of turning off of the power supplies of the plurality of propulsion devices, and the power supply control unit is arranged to turn off the switching units when the switching units are in the on state and in accordance with the priority order if the engines of all the propulsion devices in the power supplied state are all in the stopped state for not less than the predetermined time.

6. A marine vessel comprising:

a hull;

a plurality of propulsion devices attached to the hull and each provided with an engine;

a plurality of switching units arranged to turn on and off power supplies to the propulsion devices individually;

an operation judgment unit arranged to judge whether the engine of each propulsion device is in an operating state or in a stopped state;

an operational unit arranged to be operated by a user to turn on the power supplies;

a power supply control unit arranged to turn on each of the plurality of switching units in response to a power-on operation of the operational unit, and arranged to turn off a switching unit of the plurality of the switching units when a switching unit is in an on state and if the engine of the propulsion device corresponding to the switching unit is in a stopped state for not less than a predetermined time; and a start command unit arranged to generate a start command for commanding starting of the engine, wherein the power supply control unit is arranged to control a switching unit of the plurality of the switching unit to be in the on state when the switching unit is in an off state and in response to the generation of the start command by the start command unit.

7. A marine vessel comprising:

a hull;

a plurality of propulsion devices attached to the hull and each provided with an engine;

a plurality of switching units arranged to turn on and off power supplies to the propulsion devices individually;

an operation judgment unit arranged to judge whether the engine of each propulsion device is in an operating state or in a stopped state;

an operational unit arranged to be operated by a user to turn on the power supplies; and a power supply control unit arranged to turn on each of the plurality of switching units in response to a power-on operation of the operational unit, and arranged to turn off a switching unit of the plurality of the switching units when a switching unit is in an on state and if the engine of the propulsion device corresponding to the switching unit is in a stopped state for not less than a predetermined time; wherein the power supply control unit is arranged to put the plurality of switching units in the on state successively in an order determined in advance.

* * * * *